US006655110B2

(12) United States Patent
Taylor

(10) Patent No.: US 6,655,110 B2
(45) Date of Patent: Dec. 2, 2003

(54) APPARATUS TO AID IN FORMING A PACKAGE

(75) Inventor: Alfred Taylor, Chester Hill (AU)

(73) Assignee: TNA Australia Pty Limited, Chester Hill (AU)

( * ) Notice: Subject to any disclaimer, the term of this patent is extended or adjusted under 35 U.S.C. 154(b) by 100 days.

(21) Appl. No.: 10/103,653

(22) Filed: Mar. 21, 2002

(65) Prior Publication Data

US 2002/0139083 A1 Oct. 3, 2002

(30) Foreign Application Priority Data

Mar. 28, 2001 (AU) ..... PR4062

(51) Int. Cl.[7] ..... B65B 51/20
(52) U.S. Cl. ..... 53/373.9; 53/551
(58) Field of Search ..... 53/550–552, 370.7, 53/370.8, 370.9, 373.7, 373.8, 373.9, 375.9

(56) References Cited

U.S. PATENT DOCUMENTS

| | | | | |
|---|---|---|---|---|
| 2,423,237 A | * | 7/1947 | Haslacher | 53/373.9 |
| 3,562,920 A | * | 2/1971 | Vuilleumier et al. | 53/373.9 |
| 3,739,977 A | | 6/1973 | Shapiro et al. | |
| 3,741,778 A | | 6/1973 | Rowe | |
| 3,851,814 A | | 12/1974 | Stage | |
| 3,980,225 A | | 9/1976 | Kan | |
| 3,980,515 A | * | 9/1976 | Reil et al. | 53/373.9 |
| 4,176,746 A | | 12/1979 | Kooi | |
| 4,663,917 A | | 5/1987 | Taylor et al. | |
| 4,910,943 A | | 3/1990 | Taylor et al. | |
| 5,059,036 A | | 10/1991 | Richison et al. | |
| 5,118,203 A | | 6/1992 | Andronico | |
| 5,155,799 A | * | 10/1992 | Andersson et al. | 53/370.7 |
| 5,184,447 A | * | 2/1993 | Johnsen | 53/373.9 |
| 5,322,579 A | * | 6/1994 | Van Erden | 53/551 |
| 5,425,216 A | * | 6/1995 | Ausnit | 53/551 |
| 5,622,432 A | | 4/1997 | Zicker | |
| 5,842,790 A | | 12/1998 | Imer | |
| 5,848,517 A | * | 12/1998 | Yamamoto et al. | 53/551 |
| 5,971,613 A | | 10/1999 | Bell | |
| 6,033,114 A | | 3/2000 | Grimm et al. | |
| 6,038,839 A | * | 3/2000 | Linkiewicz | 53/551 |
| 6,047,528 A | * | 4/2000 | Scholin et al. | 53/373.9 |
| 6,158,200 A | | 12/2000 | Taylor et al. | |
| 6,213,645 B1 | | 4/2001 | Beer | |
| 6,224,528 B1 | | 5/2001 | Bell | |
| 6,261,215 B1 | | 7/2001 | Imer | |

FOREIGN PATENT DOCUMENTS

| | | | |
|---|---|---|---|
| EP | 934816 A1 * | 8/1999 | B29C/65/10 |
| GB | 2357991 | 7/2001 | |
| JP | 10245002 | 9/1998 | |

OTHER PUBLICATIONS

English Abstract of JP 10245002 dated Sep. 14, 1998.

* cited by examiner

*Primary Examiner*—Stephen F. Gerrity
(74) *Attorney, Agent, or Firm*—Ladas & Parry

(57) ABSTRACT

A machine 10 to aid in forming at least one flange 11 on tubular bag material 12. The machine 10 includes at least one assembly 28 provided with a longitudinally extending slot 22 through which a fold 13 passes to be heated by hot air delivered to the slot 22. A pair of pressure rollers 27 engage the heated fold 13 so that the bag material 12 of the fold 13 adheres to form the flange 11.

5 Claims, 1 Drawing Sheet

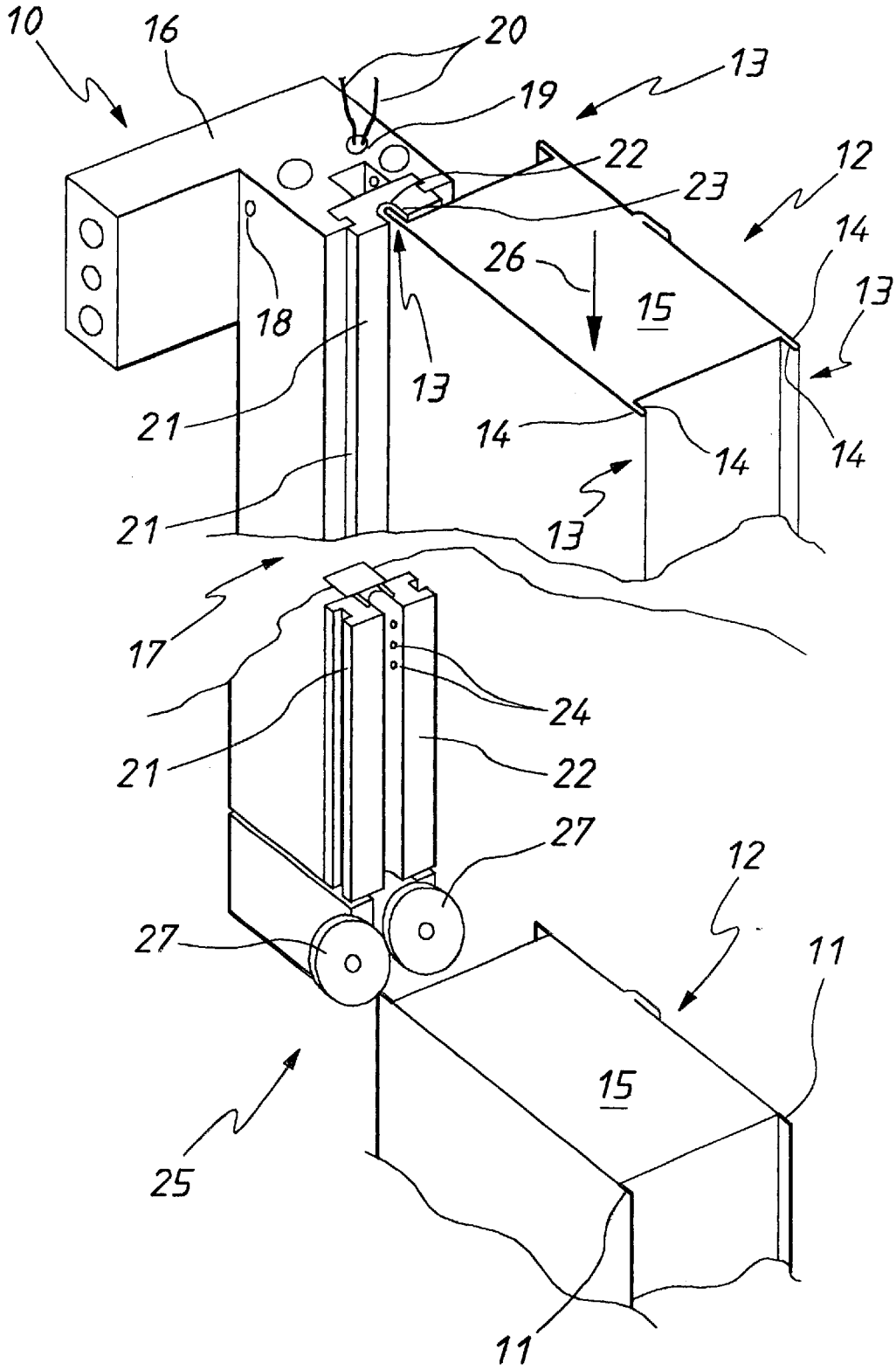
10
16
20
19
13
22
23
12
14
26
15
13
18
13
21
14
14
14
21
13
17
24
21
22
27
12
27
11
15
25
11

APPARATUS TO AID IN FORMING A PACKAGE

TECHNICAL FIELD

The present invention relates to methods and apparatus to aid in the forming of packaging.

BACKGROUND OF THE INVENTION

There is known packaging apparatus in which plastic film is removed from a roll and delivered to a former. The former forms the plastic film into a tubular configuration. The tubular bag material then passes to a packaging assembly in which the longitudinal edges of the film are sealingly joined and product delivered to internally of the tubular bag material. The tubular bag material is then transversely sealed and cut to form discreet packages.

Such packaging machines are described in U.S. Pat. Nos. 4,663,917, 6,185,200 and 4,910,943.

There is a requirement for bags to be of a square or generally rectangular configuration with corner flanges. Traditional continuous motion vertical form fill and seal packaging machines are not adapted to produce such packages.

OBJECT OF THE INVENTION

It is the object of the present invention to overcome or substantially ameliorate the above disadvantage.

SUMMARY OF THE INVENTION

There is disclosed herein a machine to aid in forming at least one longitudinal flange on tubular bag material into which there is delivered product so that when the tubular bag material is transversely sealed and cut discreet bags of the product are formed, said machine including an assembly having:

a base providing a slot along which a fold of the tubular bag material passes in a predetermined direction, the base having apertures facing said slot so as to enable the delivery of a hot gas to said slot to heat said fold;

ducts to deliver the hot gas to said apertures; and a pressure device to apply pressure to the fold so that longitudinally extending portions of the bag forming the fold adhere to form said flange.

BRIEF DESCRIPTION OF THE DRAWINGS

A preferred form of the present invention will now be described by way of example with reference to the accompanying drawing with schematically depicts a device to aid in forming longitudinally extending flanges on tubular bag material.

DETAILED DESCRIPTION OF THE PREFERRED EMBODIMENTS

In the accompanying drawing there is schematically depicted a machine 10 to aid in forming at least one flange 11 on tubular bag material 12. The tubular bag material 12 of this embodiment is of a rectangular transverse cross section and is delivered from a former to the machine 10 so that there are four longitudinally extending corner folds 13. Each fold 13 includes longitudinally extending bag portions 14. The bag portions 14 adhere to each other to form the longitudinally extending flanges 11.

In forming a bag, product is delivered to the interior 15 of the tubular bag material 12, and the bag material 12 transversely cut and transversely sealed to form discreet bags of the product.

The machine 10 includes an assembly 28 having a base 16 which is generally hollow so as to provide a chamber 17 into which air under pressure is delivered by one or more ducts 18. Attached to and extending inwardly of the base 16 is a heating element 19 which is electrically heated by means of being attached to a supply of electricity via wires 20. The element 19 heats air passing through the chamber 17.

The base 16 includes an apertured member 21 which provides a longitudinally extending slot 22 along which the tubular bag material 12 passes in the direction of the arrow 26. Typically, the tubular bag material 12 would be engaged by rollers or belts that pull the tubular bag material 12 through an associated packaging machine.

The member 22 has parallel side walls 23 defining the slot 22, which walls 23 each have a plurality of apertures 24 which by ducts are in communication with the chamber 17 so as to receive hot air therefrom. As the hot air is under pressure, jets of hot air issuing from the apertures 24. The hot air impinges upon the fold 13 so that the bag material 14 forming the folds 13 is heated.

Downstream of the slot 23 is a pressure device 25 that applies pressure to the fold 13 so that the bag material 14 of each fold adheres to form the flanges 11. In this embodiment the pressure device is a pair of cooperating rollers 27 between which the associated fold 13 passes. Typically, the rollers 27 would be adjustably mounted so that the pressure applied to the associated fold 13 may be adjusted to suit the particular bag material and heating conditions.

In the above-described preferred embodiment only one assembly 28 of the machine 10 is described. In this respect it should be appreciated that a machine 10 would require an assembly 28 for each of the folds 13. Accordingly, in the above-described preferred embodiment four assemblies 28 would be required. However, in forming packages of other configuration, the number of assemblies 28 will change. For example, two assemblies 28 may be used to form a package with a "stand up base" or satchel.

The claims defining the invention are as follows:

1. A machine to aid in forming at least one longitudinal flange on tubular bag material into which there is delivered product so that when the tubular bag material is transversely sealed and cut discreet bags of the product are formed, said machine including an assembly having:

a base providing a slot along which a fold of the tubular bag material passes in a predetermined direction, the base having apertures facing said slot so as to enable the delivery of a hot gas to said slot to heat said fold;

ducts to deliver the hot gas to said apertures; and a pressure device to apply pressure to the fold so that longitudinally extending portions of the bag forming the fold adhere to form said flange.

2. The machine of claim 1 wherein said base includes a chamber into which air under pressure is delivered, with said ducts extending from said apertures to said chamber so as to receive said air, and said machine further includes a heating element mounted in said base and electrically operated to heat air passing through said chamber.

3. The machine of claim 2 wherein said pressure device is a pair of rollers positioned downstream of said slot in said predetermined direction, the rollers being positioned to engage opposite sides of the fold.

4. The machine of claim 3 wherein said slot is defined between a pair of opposing generally parallel longitudinally extending side walls, with each side wall having a plurality of said apertures.

5. A machine of claim 4 when adapted to aid in forming two or four longitudinally extending flanges on tubular bag material into which there is delivered product so that when the tubular bag material is transversely sealed and cut, discreet bags of product are formed, and wherein said assembly is a first assembly, and said machine includes a further assembly for each flange.

* * * * *